US009115583B2

(12) United States Patent
Usui et al.

(10) Patent No.: US 9,115,583 B2
(45) Date of Patent: Aug. 25, 2015

(54) COMPRESSOR

(75) Inventors: Keigo Usui, Saitama (JP); Kiyotaka Tanaka, Saitama (JP)

(73) Assignee: CALSONIC KANSEI CORPORATION, Saitama (JP)

( * ) Notice: Subject to any disclaimer, the term of this patent is extended or adjusted under 35 U.S.C. 154(b) by 549 days.

(21) Appl. No.: 13/326,741

(22) Filed: Dec. 15, 2011

(65) Prior Publication Data

US 2012/0156072 A1 Jun. 21, 2012

(30) Foreign Application Priority Data

Dec. 16, 2010 (JP) ..... 2010-280052

(51) Int. Cl.
*F04C 29/12* (2006.01)
*F01C 21/10* (2006.01)
*F04C 18/344* (2006.01)

(52) U.S. Cl.
CPC ..... *F01C 21/10* (2013.01); *F04C 29/12* (2013.01); *F04C 18/344* (2013.01)

(58) Field of Classification Search
CPC ..... F04C 2250/101; F04C 2210/26–2210/268; F04C 29/026; F04C 29/028; F04C 15/06; F01C 21/0863; F01C 21/0872; F01C 21/10; F01C 21/108
USPC ..... 417/410.3, 540, 542, 543; 418/DIG. 1, 418/96, 97, 98, 259, 253
See application file for complete search history.

(56) References Cited

U.S. PATENT DOCUMENTS

| | | | | |
|---|---|---|---|---|
| 4,502,854 | A * | 3/1985 | Shibuya et al. | 418/15 |
| 5,411,385 | A | 5/1995 | Eto et al. | |
| 6,851,940 | B2 | 2/2005 | Ono | |
| 6,935,854 | B2 * | 8/2005 | Kuwahara | 418/259 |
| 7,029,243 | B2 | 4/2006 | Ono | |
| 2004/0001771 | A1 | 1/2004 | Kuwahara | |
| 2005/0129559 | A1 * | 6/2005 | Hasegawa et al. | 418/63 |

FOREIGN PATENT DOCUMENTS

| | | |
|---|---|---|
| CN | 1434215 | 8/2003 |
| CN | 1459571 A | 12/2003 |
| JP | 63-1790 | 1/1988 |
| JP | 63-173893 | 7/1988 |
| JP | 9-68180 | 3/1997 |
| JP | 2002-242835 | 8/2002 |
| JP | 2008-8259 | 1/2008 |

OTHER PUBLICATIONS

Chinese Office Action (OA) issued Jan. 20, 2014 in corresponding Chinese Patent Application No. 201110216994.7.
Chinese Office Action issued on Sep. 9, 2014 in corresponding Chinese Application No. 201110216994.7.

* cited by examiner

*Primary Examiner* — Peter J Bertheaud
*Assistant Examiner* — Dnyanesh Kasture
(74) *Attorney, Agent, or Firm* — Wenderoth, Lind & Ponack, L.L.P.

(57) ABSTRACT

A compressor includes a housing including a case and a front head attached to the case, a compressor body contained in the housing, and an intake chamber provided in the front head between the compressor body and the front head. A lower part of the front head forming the intake chamber is positioned further away from the case than an upper part of the front head to increase a capacity of the intake chamber.

5 Claims, 4 Drawing Sheets

COMPRESSOR

CROSS-REFERENCE TO THE RELATED APPLICATION

This application is based on and claims the priority benefit of Japanese Patent Application No. 2010-280052, filed on Dec. 16, 2010, the disclosure of which is incorporated herein by reference in its entirety.

BACKGROUND OF THE INVENTION

1. Field of the Invention

The present invention relates to a compressor, more specifically to an improvement in a front head constituting a housing surrounding a compressor body.

2. Description of the Related Art

It is known that a compressor is used for an air-conditioning system. The compressor is configured to compress refrigerant (gas refrigerant) and so on and circulate the gas refrigerant to the air-conditioning system.

For example, there is known a compressor including a compressor body which is contained in a housing including a case and a front head, and includes a cylindrical body contained in the case, a rotational shaft rotated about an axis, a circular post-shaped rotor rotatable integrally with the rotational shaft and is contained in the cylindrical body, a front side block disposed to cover one end of the cylindrical body, and a rear side block disposed to cover another end of the cylindrical body (see, Japanese Patent Application Publication No. 2008-008259).

The compressor includes an intake chamber which is disposed between an outer surface of the compressor body and an inner surface of the housing and through which gas refrigerant introduced in the compressor body passes, and a discharge chamber which is provided in a side of the compressor body opposite to the intake chamber and through which gas refrigerant discharged from the compressor body passes.

Under circumstances of a low outside temperature such as winter, the operation of an air-conditioning system circulating gas refrigerant becomes less frequent, and when a compressor remains unused for a long time under a lower temperature, gas refrigerant is almost liquefied.

Such a liquefaction of the gas refrigerant occurs in either an intake side or a discharge side, in the conventional compressor as mentioned above, a liquid level of liquefied refrigerant in the intake chamber rises, and thereby there is a case that the liquid level reaches an inlet for passing the gas refrigerant from the intake chamber to the compressor body.

In this way, if the liquid level reaches the inlet, liquid is absorbed into the compressor body (compression chamber), there is a problem that liquid compression occurs in the compression chamber, the liquid compression cause adverse effects on durability of a compressor. In addition, with such a liquid compression, there is a problem that abnormal sound (compression sound) occurs.

SUMMARY OF THE INVENTION

An object of the present invention is to provide a compressor capable of preventing liquefied refrigerant from being absorbed into a compressor body and inhibiting occurrence of liquid compression and abnormal sound.

To accomplish the above object, a compressor according to an embodiment of the present invention includes a case and a front head attached to the case, a compressor body contained in the housing, and an intake chamber provided in the front head between the compressor body and the front head. A part of the front head forming the intake chamber is extended to increase a capacity of the intake chamber.

DETAILED DESCRIPTION OF THE PREFERRED EMBODIMENTS

A preferred embodiment of the present invention will be explained in detail hereinafter with reference to the accompanying drawings.

Figure 1:
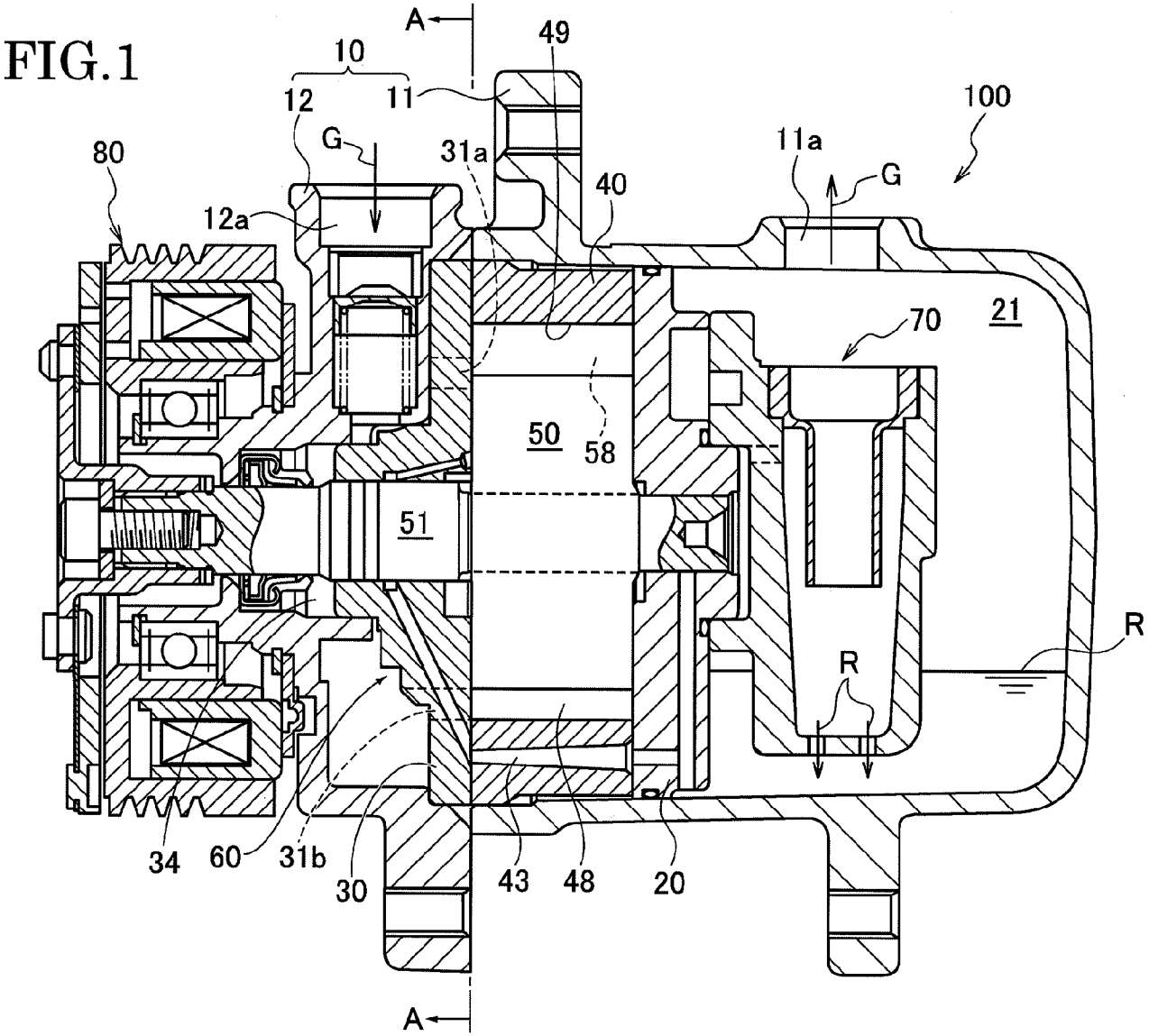
FIG. 1 is a sectional view showing an embodiment of a compressor according to the present invention.

FIG. 1 illustrates an embodiment of a compressor 100 according to the present invention.

The compressor 100 is structured as a part of an air-conditioning system configured to cool air, for example, by use of vaporization heat of compressed refrigerant and is provided in a circulation route of refrigerant together with a condenser, an expansion valve, an evaporator and so on which are not shown and are other elements of the air-conditioning system.

The compressor 100 compresses gas refrigerant G introduced therein through the evaporator of the air-conditioning system, and supplies the compressed gas refrigerant G to the condenser of the air-conditioning system. The condenser liquefies the compressed gas refrigerant G and the supplies the liquefied refrigerant at a high pressure to the expansion valve (not shown).

The expansion valve reduces a pressure of the liquid refrigerant and supplies it to the evaporator. The evaporator evaporates the liquefied refrigerant having a lower pressure by absorbing heat from circumambient air to cool the circumambient air through heat exchange by the vaporization heat.

As shown in FIG. 1, the compressor 100 includes a housing 10 having a case 11 and a front head 12 attached to the case 11, a compressor body 60 contained in the housing 10, and a transmission mechanism 80 which is attached to the front head 12 and transmits a drive force from a drive source (not shown) to the compressor body 60.

The case 11 has a cylindrical shape which has one end closed. The front head 12 is attached to the case 11 to cover an opened end portion of the case 11. The front head 12 includes an intake port 12*a* to introduce gas refrigerant G having a lower pressure from the evaporator therein. The case 11 includes a discharge port 11*a* to discharge gas refrigerant G having a high pressure compressed by the compressor body 60 to the condenser.

The compressor body 60 includes a cylindrical body 40 which has a chamber 49 and is contained in the case 11, a rotational shaft 51 rotated about an axis by a drive force transmitted by the transmission mechanism 80, a circular post-shaped rotor 50 which is rotatable integrally with the rotational shaft 51 and is contained in the chamber 49 of the cylindrical body 40, a front side block 30 disposed to cover one end of the cylindrical body 40, and a rear side block 20 disposed to cover another end of the cylindrical body 40.

As shown in FIG. 1, an intake chamber 34 to pass the gas refrigerant G introduced in the compressor body 60 is formed between an outer surface of the front side block 30 and an inner surface of the front head 12 of the compressor body 60.

In addition, a plurality of inlets 31 (inlets 31*a* and 31*b* in the embodiment) to introduce the gas refrigerant G passed through the intake chamber 34 into the compressor body 60 are provided in a side wall (front side block 30) of the compressor body 60 facing the intake chamber 34. The inlets 31*a* and 31*b* are disposed to have a different height in a used state. In the embodiment, the inlet 31*a* is disposed on a position higher than that of the inlet 31*b*. Meanwhile, reference number 43 shows a communication passage which is provided in the cylinder body 40 and communicates with a passage provided in the front side block 30.

A plurality of plate-shaped vanes 58 is provided on a rotor 50. The vanes 58 are provided on the rotor 50 at intervals in a circumferential direction thereof. In the embodiment, a lower end portion of each vane is disposed in each of grooves provided in the rotor 50 to be capable of being moved in and out of the grooves as the rotor 50 rotates. More, specifically, each of the vanes 58 is configured to be capable of being projected from an outer circumferential surface 49 of the rotor 50 outwardly, and a projected amount of a leading end portion of each vane is variable so as to follow a profile shape of an inner circumferential surface of the cylinder body 40.

A plurality of compressed chambers 48 is formed in a space in the cylinder body 40 surrounded by the rear side block 20, the front side block 30 and the rotor 50 by means of two adjacent vanes 58, 58 in a rotation direction of the rotational shaft 51. A capacity of each of the compressed chambers 48 is repeatedly increased and decreased as the rotational shaft 51 and the rotor 50 are rotated by a drive force transmitted by the transmission mechanism 80. Thereby, through the operation, the gas refrigerant G introduced in each of the compressed chambers 48 is compressed and discharged from the compressed chambers through a discharge passage (not shown) provided in the rear side block 20 and a cyclone block 70 which is an oil separator into a discharge chamber 21.

The discharge chamber 21 is a chamber in which gas refrigerant G having a high pressure discharged from the compressor body 60 is introduced. The discharge chamber 21 is formed by the rear side block 20 and the case 11.

<Structure of Front Head>

Figure 2:
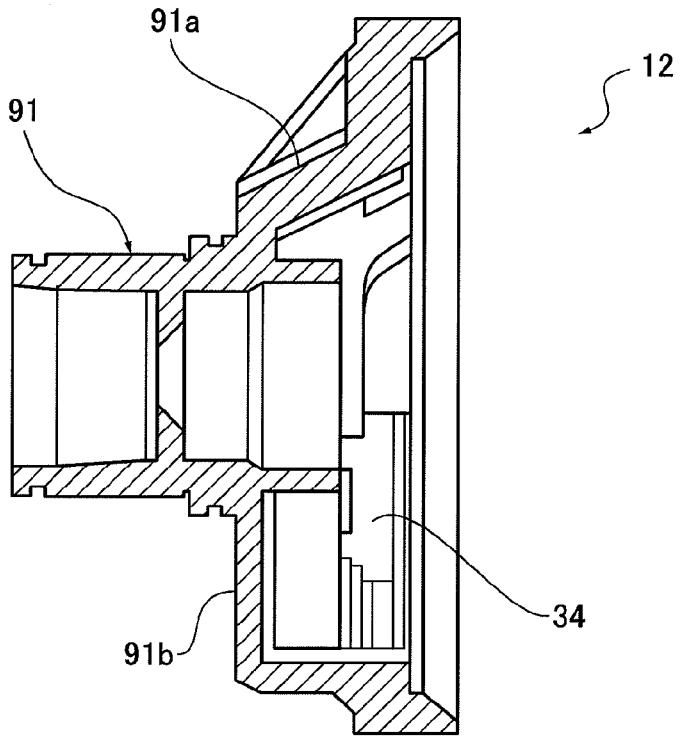
FIG. 2 is a sectional view of a front head used in the compressor according to the present invention.
Figure 3:
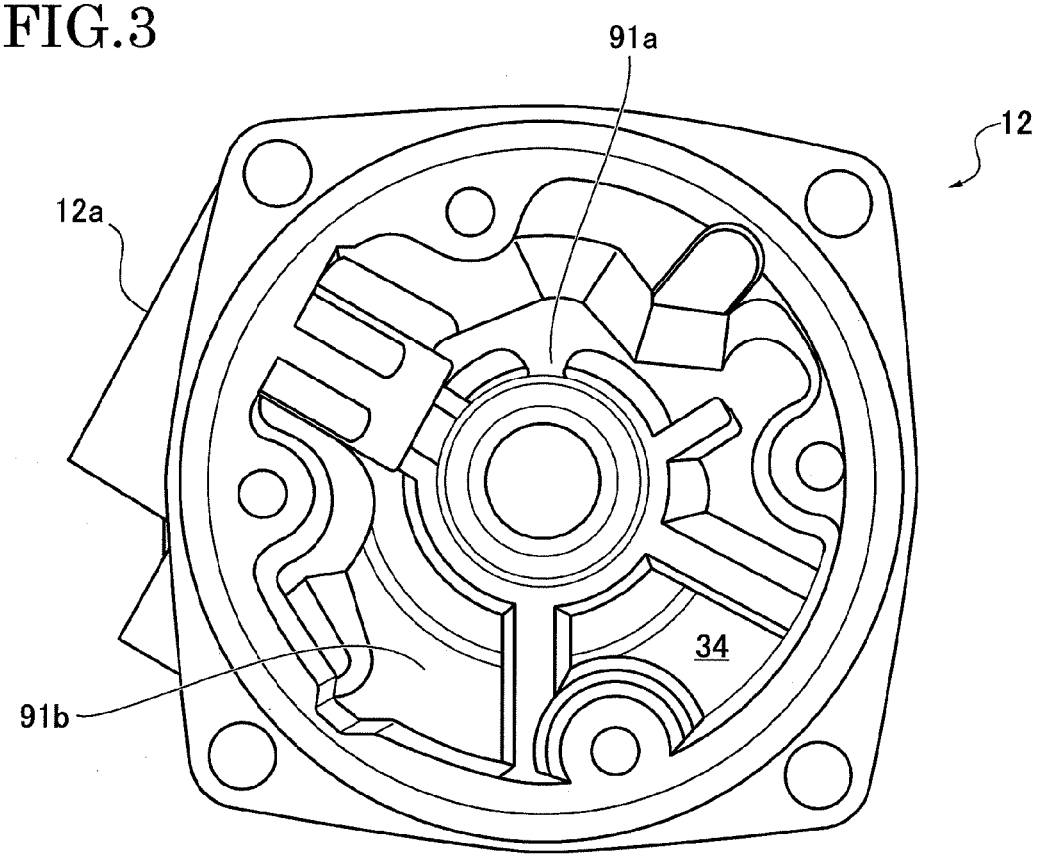
FIG. 3 is a front view taken along line A-A in FIG. 1.

FIGS. 2 and 3 illustrate the front head as shown in FIG. 1.

At least a lower wall portion 91*b* of a wall portion 91 of the front head 12 is extended in a depth direction (a left direction in FIG. 2) of the intake chamber 34 along the axis of the rotational shaft 51.

Figure 5:
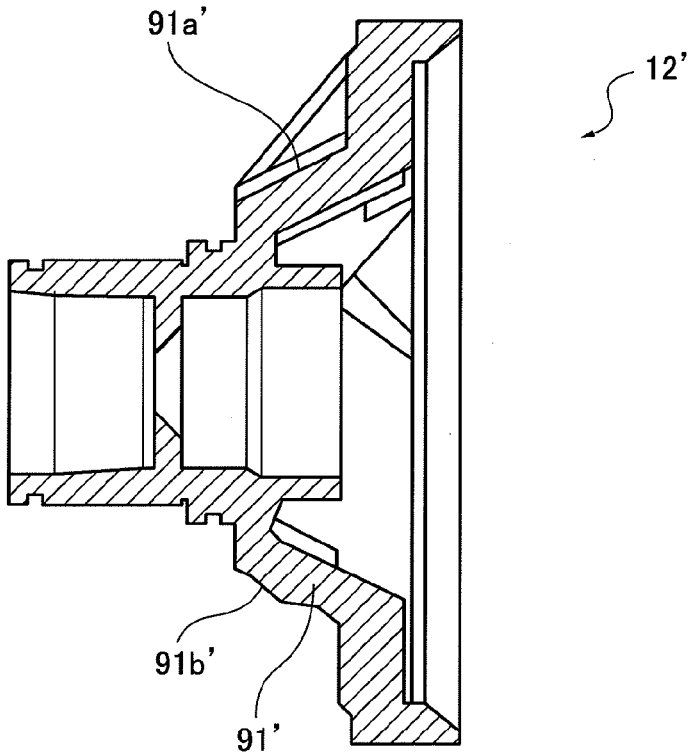
FIG.5 (PRIOR ART)
FIG. 5 is an enlarged view showing a conventional front head.
Figure 6:
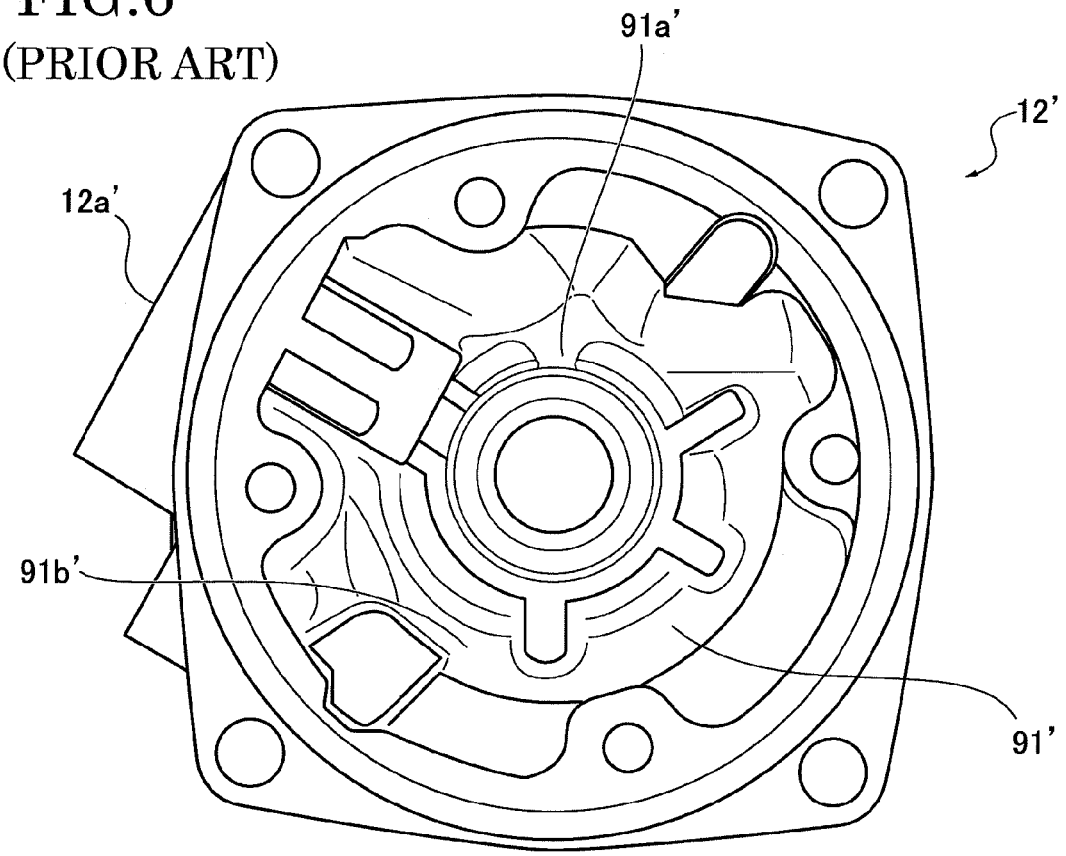
FIG.6 (PRIOR ART)
FIG. 6 is a sectional view showing a structure of the conventional front head shown in FIG. 5.

Here, as shown in FIGS. 5 and 6, a conventional front head 12' includes a wall portion 91' having an upper wall portion 91*a*' and a lower wall portion 91*b*', which extends to incline upwardly in a rotational shaft (not shown) toward a side (right direction in FIG. 5) of a case (not shown).

On the contrary, in the front head 12 in the illustrated embodiment as mentioned above, at least the lower wall portion 91*b* of the wall portion 91 of the front head 12 is extended in the depth direction or to a left side in FIG. 2) of the intake chamber 34 along the rotational shaft 51, and the upper wall portion 91*b* of the front head 12 extends to enlarge obliquely and upwardly toward the case 11.

Consequently, the front head 12 according to the present invention, compared with the conventional front head 12', makes it possible to increase a capacity of only the lower side portion of the intake chamber 34. A capacity of an upper side portion of the intake chamber 34 is similar to that of an intake chamber of the conventional front head 12'.

Here, the term, "at least a lower wall portion or lower side portion" means a portion of the front head lower than the inlet 31*a* which is provided at an uppermost position of the plurality of inlets 31*a* and 31*b* provided in the front side block 30.

Next, an operation to prevent liquefied refrigerant from being absorbed in the compressor body 60 by the compressor 100 according to the present invention is explained.

Figure 4:
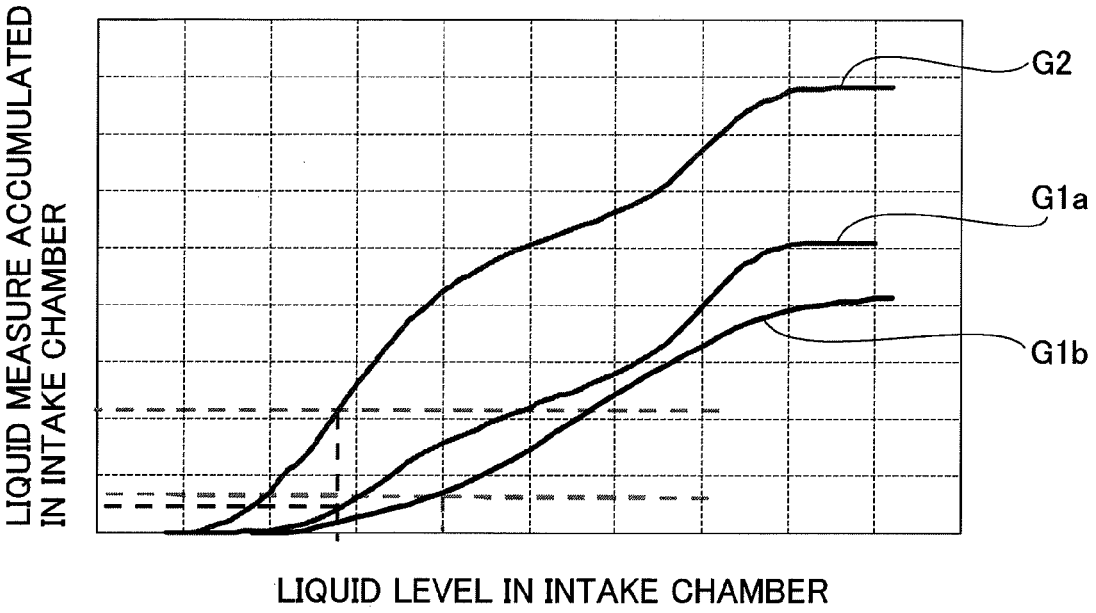
FIG. 4 is a graph showing a relationship between a liquid level in an intake chamber and a liquid measure accumulated in the intake chamber, in the compressor as shown in FIG. 1.

FIG. 4 is a graph showing a relationship between a liquid level in the intake chamber 34 and a liquid measure accumulated in the intake chamber 34, in the compressor 100 as shown in FIG. 1.

In a compressor provided with the conventional front head 12' as shown in FIGS. 5 and 6, a relationship between a liquid level in an intake chamber and a liquid measure accumulated in the intake chamber is as shown in a graph G1*a* in FIG. 4. In addition, although there is a case in which an intake port 12*a*' of the conventional front head 12' is positioned on a vertical line of the front head, in such a case, a relationship between a liquid level in the intake chamber and a liquid measure accumulated in the intake chamber is as shown in a graph G1*b* in FIG. 4.

On the contrary, a relationship between a liquid level in an intake chamber and a liquid measure accumulated in the intake chamber, in the compressor 100 according to the present invention is as shown in a graph G2 in FIG. 4. It is demonstrated from the graphs G1*a*, G1*b* and G2 that in the same liquid level, a liquid measure larger than a liquid measure accumulated in the conventional intake chamber can be accumulated in the intake chamber 34, in other words, if a liquid measure accumulated in the conventional intake chamber is accumulated in the intake chamber 34 according to the present invention, a liquid level in the intake chamber 34 is lower than that in the conventional intake chamber. This is because the capacity of the lower portion of the intake chamber 34 is larger than that of the conventional intake chamber.

In this way, when liquefied refrigerant is introduced in the intake port 12*a* of the compressor 100 according to the present invention, the liquefied refrigerant is accumulated in a lower portion of the intake chamber 34. Because the capacity of the lower portion of the intake chamber 34 is larger than that of the conventional intake chamber, a liquid level in the intake chamber 34 is reduced, compared with a case in which the same amount of liquid is introduced in the conventional intake chamber.

With the above structure, because the intake chamber 34 has a large capacity, even if gas refrigerant G is liquefied, it is possible to prevent the liquid level in the intake chamber 34 from being increased, thereby the liquefied refrigerant is prevented or restricted from being absorbed in compressor body 60. Consequently, it is possible to eliminate compression of liquid and occurrence of abnormal sound when the liquid is compressed.

In addition, because the lower wall portion 91*b* is extended in the depth direction of the intake chamber 34 along the rotational shaft 51 in a range of length of the rotational shaft 51 to increase the capacity of the intake chamber, it is not necessary to increase an outside dimension of the entire compressor 100.

According to the compressor 100 of the present invention, structured as mentioned above, the plurality of inlets 31*a* and 31*b*, which are different from each other in height in a used state, are provided in a side wall (front side block 30) of the compressor body 60 facing the intake chamber 34. At least the lower wall portion 91*b*, which is extended in the depth direction of the intake chamber 34, of the wall portion 91 of the front head 12 is positioned at a lower position than the inlet 31*a* provided at the uppermost position of the plurality of inlets 31*a* and 31*b*, thereby the capacity of the lower portion of the intake chamber is larger than the inlet 31*a* at the uppermost position of the intake chamber 34. Consequently, it is possible to prevent a level of liquid accumulated in the intake chamber 34 from reaching inlet 31*a*, even if almost all of the gas refrigerant G is liquefied, it is possible to prevent the liquefied refrigerant from being absorbed through the inlet 31*a* into the compressor body 60.

In addition, in the compressor 100 according to the present invention structure as mentioned above, because only the lower wall portion 91*b* of the front head 12 is extended in the depth direction of the intake chamber along the rotational shaft 51, it is not necessary to extend the upper wall portion 91*a* of the front head 12 in the depth direction of the intake chamber 34. Consequently, it is prevented that the capacity of the intake chamber 34 is excessively increased and therefore a pressure loss can be reduced.

Although the preferred embodiment of the present invention has been described with reference to FIGS. 1 to 6, it should be understood that the present invention is not limited to the embodiment, various changes and modifications can be made to the embodiment.

For example, a part of the front side block may be extended to increase the capacity of the intake chamber.

What is claimed is:

1. A compressor, comprising:

a housing including a case and a front head attached to the case;

a compressor body contained in the housing and including a rotational shaft; and an intake chamber provided in the front head between the compressor body and the front head, wherein the front head includes an intake port, an upper wall portion and a lower wall portion, wherein an uncompressed fluid enters through the intake port into the intake chamber, and the uncompressed fluid is subsequently transferred from the intake chamber to the compressor body for compression, wherein the upper wall portion is closer to the intake port than the lower wall portion, wherein the lower wall portion has an inner surface facing the case, the inner surface of the lower wall portion being planar and perpendicular to a longitudinal axis of the rotational shaft, and wherein the upper wall portion of the front head extends obliquely and upwardly toward the case, and the lower wall portion of the front head is extended further away from the case than the upper wall portion in a direction parallel with the longitudinal axis of the rotational shaft to increase a capacity of the intake chamber.

2. The compressor according to claim 1, further comprising a plurality of inlets provided in a side wall of the compressor body facing the intake chamber, the inlets being at different levels, wherein the inner surface of the lower wall portion is positioned below an uppermost one of the inlets.

3. The compressor according to claim 1, wherein at least a section of the lower wall portion is positioned perpendicular to the rotational shaft.

4. The compressor according to claim 3, wherein at least a section of the upper wall portion is positioned oblique to the rotational shaft.

5. The compressor according to claim 1, wherein at least a section of the upper wall portion is positioned oblique to the rotational shaft.

* * * * *